United States Patent [19]

Yawn et al.

[11] Patent Number: 4,633,586

[45] Date of Patent: Jan. 6, 1987

[54] SAFETY CHISEL

[75] Inventors: James M. Yawn, Bonaire; Huby M. Whitaker, Dry Branch; Frank Bridgers, Macon, all of Ga.

[73] Assignee: J. M. Huber Corporation, Rumson, N.J.

[21] Appl. No.: 715,857

[22] Filed: Mar. 25, 1985

[51] Int. Cl.[4] ..... B25D 3/00

[52] U.S. Cl. ..... 30/168; 30/277

[58] Field of Search ..... 30/168, 277, 180, 182; 29/275; 83/639

[56] References Cited

U.S. PATENT DOCUMENTS 806,493 12/1905 Plummer ..... 30/180
1,069,528 8/1913 Chandler ..... 30/168
1,102,162 6/1914 Norman ..... 30/168
1,320,191 10/1919 Ash ..... 30/168
1,554,790 9/1925 Crowe ..... 30/168
4,520,564 6/1985 Wivinis ..... 30/168

FOREIGN PATENT DOCUMENTS 33914 11/1912 Sweden ..... 30/168

*Primary Examiner*—Jimmy C. Peters
*Attorney, Agent, or Firm*—Harold H. Flanders; Alec H. Horn; August E. Roehrig, Jr.

[57] ABSTRACT

A safety chisel especially adapted to shear bolts having a nut permanently attached thereto, while retaining the sheared bolt and nut assembly within a safety container portion of the chisel.

4 Claims, 4 Drawing Figures

FIG. 1
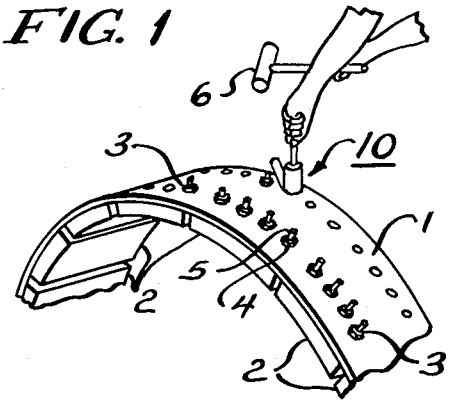
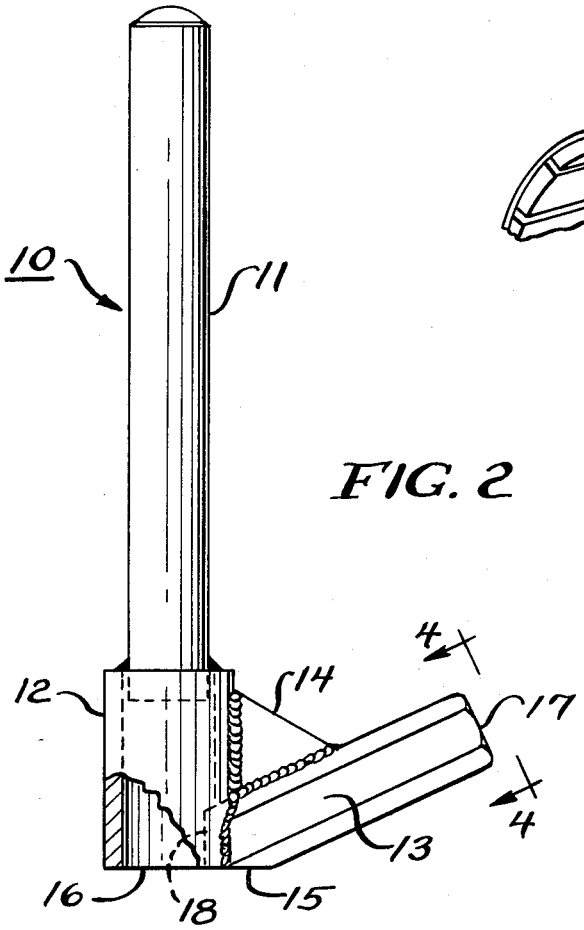
FIG. 2
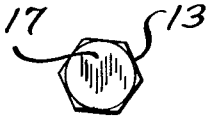
FIG. 4
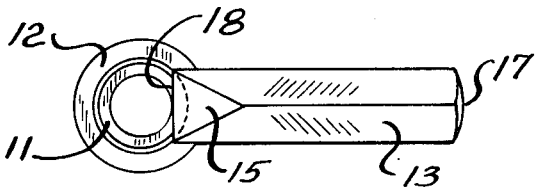
FIG. 3

SAFETY CHISEL

BACKGROUND OF THE INVENTION

This invention relates in general to hand tools and, in particular, to a safety chisel especially adapted to shear bolts having a nut permanently attached thereto, while retaining the sheared bolt and nut assembly within a safety container portion of the chisel.

In certain applications, such as securing a brake band onto a brake block, self-locking nuts are utilized on brake lock bolts to secure the brake band to the brake block, with the intention that the nuts will be permanently secured to the brake block bolts. Once these self-locking nuts are installed, they are not intended to be threadingly disengaged, but are constructed such that the installation is permanent. Until such time as the brake bands must be repaired, the brake block nut and bolt assembly forms an integral part.

In other instances, even where a nut and bolt assembly is secured without such a permanent assembly being intended, it is well known that through rust, corrosion, or other deterioration-inducing factors, nuts become impossible to be threadingly removed from the bolt upon which they were engaged. Under such circumstances, the bolt upon which the nut is secured, or the nut itself, must be cut or sheared so that the portion of the bolt remaining can then be knocked out of the hole and replaced.

Such a shearing operation, however, frequently results in the sheared portion of the nut and bolt assembly flying about in an unpredictable direction, which can cause injury to any personnel in the area or damage equipment with which it may impact or become entangled.

The present invention provides a safety chisel which permits a bolt to be sheared, while the nut and portion of the bolt to which the nut is affixed are entrapped and contained within a safety container. The safety container prevents the broken portion of the bolt and nut from being propelled by the shearing force in an undetermined and unsafe direction.

SUMMARY OF THE INVENTION

It is, therefore, an object of this invention to improve hand tools.

Another object of this invention is to safely contain a sheared portion of a nut and bolt assembly within a predetermined confinement to prevent the severed part from flying about unrestrained in an unpredictable direction.

A further object of this invention is to provide a safer working environment for persons and equipment in the vicinity of an operation wherein a chisel is being utilized to shear a bolt and nut frozen thereon.

These and other obects are attained in accordance with the present invention, wherein there is provided a safety chisel including a hardened chisel stock portion positioned to engage and sever a bolt upon which a nut is secured thereon against threadingly removal. The safety chisel includes a handle portion for placing and holding the chisel adjacent the bolt to be sheared, and a safety container which encompasses the portion to be sheared during the chiseling operation and prevents the severed portion from being propelled in an undetermined and unsafe direction.

DESCRIPTION OF THE DRAWINGS

Further objects of the invention together with additional features contributing thereto and advantages accruing therefrom will be apparent from the following description of a preferred embodiment of the invention which is shown in the accompanying drawings with like reference numerals indicating corresponding parts throughout, wherein:

FIG. 1 is a perspective view of the invention being utilized in an application to shear self-locking nuts from brake block bolts utilized to secure a brake block to a brake band;

FIG. 2 is an enlarged side view of the safety chisel shown in FIG. 1 to better illustrate the features thereof;

FIG. 3 is a view of the safety chisel shown in FIG. 2 from the bottom thereof; and FIG. 4 is a partial sectional view of the safety chisel shown in FIG. 2 taken along lines 4—4.

DESCRIPTION OF A PREFERRED EMBODIMENT

Referring now to FIG. 1, there is shown a brake band 1 such as used in a large drag line shovel, wherein the brake band 1 has a plurality of brake blocks 2 secured thereto by means of a plurality of nut and bolt assemblies 3 such as for example, a three-eighths inch brass bolt utilizing a self-locking nut. While the safety chisel 10, to be described in detail hereinafter, has many and general applications, for convenience of illustration it is shown being used in an application wherein a self-locking nut 4 is used in combination with a three-eighths brass bolt 5 to secure the brake block/brake band assembly. In such an application the brass bolt 5 is severed in order to remove the self-locking nut 4 when brake band repair is necessary. To this end, the safety chisel 10 is manually placed over the exposed nut and bolt assembly 3 and struck, such as by a hammer 6, which shears the bolt 5 while retaining the severed nut and bolt portion within a safety container retaining portion 12 of the safety chisel.

The details of the safety chisel 10 are best shown in FIGS. 2–4. The safety chisel 10 includes a handle portion 11 for providing a convenient and secure grip for the user during the severing operation. For example, a three-quarter inch standard iron pipe of approximately eight and one-half inches in length has been found to provide a suitable handle for this purpose. The safety container retaining portion or housing 12 is concentrically secured to one end of the handle 11, such as by welding, and is of a size sufficient to encompass the portion of the nut and bolt assembly 3 which will be severed from the bolt. In use it has been found that a one and one-quarter inch standard iron pipe of approximately two and one-half inches in length is suitable for encompassing the bolt and nut assembly 3. In view of the hollow center of the handle 11, if the bolt 5 to be severed extends a distance longer than the two and one-half inch height of the retaining container 12, the extending portion will be accommodated due to the hollow interior of the pipe handle.

A chisel or force transmitting portion 13 is secured to the lower portion of the safety container housing 12 and is affixed thereto at an angle, such as approximately 25°, by means of a one-quarter inch gusset plate 14. The gusset plate 14 is welded along the side of the chisel or force transmitting portion 13 and to the outer peripheral portion of the safety container housing 12 to provide a suitable strengthener securing the chisel portion 13 to the safety container housing.

The chisel portion 13 is preferably made of hardened hexagonally-shaped chisel stock, as shown in the cross-section 4—4. As best shown in FIGS. 2 and 3, the chisel portion 13 has a flattened base portion 15 formed such that the bottom portion or free open end 16 of the safety container 12 and the surface 15 of the base portion are co-planar permitting the safety chisel 10 to encompass the portion of the nut and bolt assembly 3 to be severed, permitting a more effective shearing force to be applied across the bolt 3. The chisel portion 13 is also formed at one end with a striking face 17 for receiving the impact of the hammer 6 to impart the shearing force to the bolt 3. The other end of the chisel portion 13 is formed, as shown, with a vertically extending edge 18, or with a vertically extending planar face. The edge 18 or vertical face forms a contact surface which abuts a portion of the nut and bolt assembly 3 inserted within the container 12, to apply the shearing force when the striking face 17 is struck by the hammer 6. In this manner the impact force will be delivered over a wide surface to effect shearing of the bolt 3 while retaining the sheared portion within the confines of the container portion 12.

While the invention has been described in the specification and illustrated in the drawings with reference to a preferred embodiment, it will be understood by those skilled in the art that various changes may be made and equivalents may be substituted for elements thereof, without departing from the scope of the invention. In addition, many modifications may be made to adapt a particular situation or materials to the teachings of the invention without departing from the essential scope thereof. Therefore, it is intended that the invention not be limited to the particular embodiment illustrated by the drawings described in the specification as the manner presently contemplated for carrying out this invention, but that the invention will include any embodiment falling within the scope of the appended claims.

What is claimed is:

1. A safety chisel for use in shearing a bolt upon which a nut has become permanently affixed, comprising a handle for positioning the safety chisel upon a nut and bolt assembly to be severed and for holding the safety chisel in position during severing operation, said handle including a retaining container extending coaxially from an end of said handle and having a closed end fixed to said end of said handle, said retaining container having an open free end adapted to receive therethrough and surround therein the portion of the nut and bolt assembly which is inserted therethrough to be severed free during the severing operation, said retaining container in cooperation with a surface upon which the nut and bolt assembly is mounted forming a closed housing, a force transmitting portion secured to said retaining container and having a first end thereof forming a striking face for receiving an impact force to be transmitted to the nut and bolt assembly for effecting the severing operation, and said force transmitting portion having a second impacting end which extends within the inner peripheral surface of said retaining container and is adpated to be positioned in contact with the nut and bolt assembly when the nut and bolt assembly has been received within said retaining container for transmitting an impact force thereagainst upon said striking face receiving an impact force to sever the nut and bolt assembly, said second impacting end comprising a flat planar impacting face extending vertically upward relative to the surface upon which the nut and bolt assembly is mounted and positioned in contact with said nut and bolt assembly when the nut and bolt assembly is received within said retaining container.

2. The apparatus of claim 1 wherein said force transmitting portion is secured to said retaining container by a gusset plate.

3. The apparatus of claim 1 wherein said open free end of said retaining container is co-planar with a portion of said second end of said force transmitting portion which extends therewithin to form an impacting end.

4. The apparatus of claim 1 wherein said force transmitting portion extends upwardly and outwardly from said retaining container at an angle of approximately 25° from the plane of said open free end thereof.

* * * * *